United States Patent [19]

Skoog

[11] 4,376,460

[45] Mar. 15, 1983

[54] PLATE HEAT EXCHANGER

[75] Inventor: Malte Skoog, Lund, Sweden

[73] Assignee: Alfa-Laval AB, Tumba, Sweden

[21] Appl. No.: 218,697

[22] Filed: Dec. 22, 1980

[30] Foreign Application Priority Data

Jan. 9, 1980 [SE] Sweden ..... 8000159

[51] Int. Cl.[3] ..... F28D 9/02; F28F 3/04

[52] U.S. Cl. ..... 165/167

[58] Field of Search ..... 165/166, 167

[56] References Cited

U.S. PATENT DOCUMENTS 2,937,856 5/1960 Thomson ..... 165/167
4,230,179 10/1980 Uehara et al. ..... 165/167X
4,307,779 12/1981 Johansson et al. ..... 165/167 X

FOREIGN PATENT DOCUMENTS 1211065 11/1970 United Kingdom ..... 165/166

*Primary Examiner*—Sheldon J. Richter
*Attorney, Agent, or Firm*—Cyrus S. Hapgood

[57] ABSTRACT

In a heat exchanger comprising a plurality of plates arranged adjacent to each other and provided with turbulence-generating corrugations, sealed passages for two heat exchanging media are enclosed between the plates, and two heat exchanging media flow through the passages in mutually inclined flow directions. In order to provide different thermal properties of the passages for the two media, the corrugations on an average extend at a wider angle relative to the flow direction of one of the media than to that of the other medium.

13 Claims, 10 Drawing Figures

PLATE HEAT EXCHANGER

Figure 1:
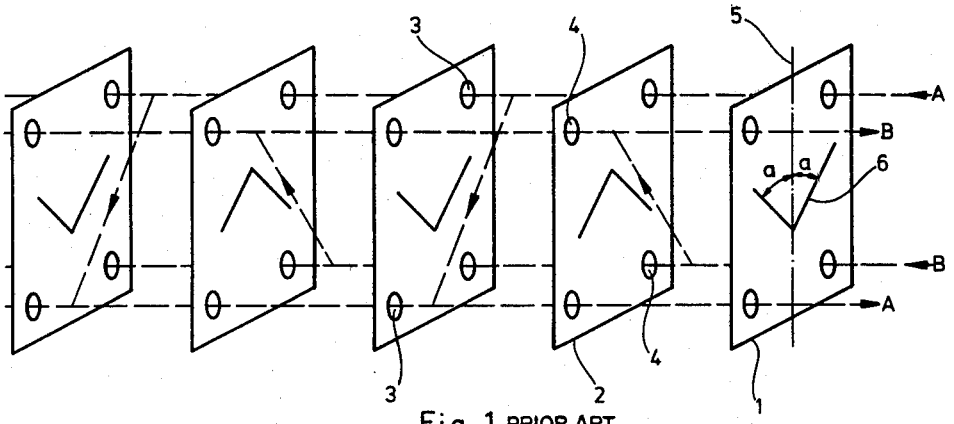
Fig. 1 PRIOR ART

The present invention relates to a heat exchanger of the type comprising a plurality of generally rectangular plates arranged adjacent to each other and provided with turbulence-generating corrugations, said plates enclosing sealed passages for receiving two heat exchanging media flowing therethrough in mutually inclined flow directions.

By arranging the corrugations of adjacent plates inclined to each other, a large number of supporting points are provided in which the ridges of adjacent plates abut. In known heat exchangers of this kind, the corrugations are usually arranged in a so-called herringbone pattern, which means that the ridges and grooves forming the corrugations are broken along the longitudinal axis of the plate and on both sides of said axis extend at the same angle thereto. In this type of plate, the angle between the corrugations of adjacent plates is provided by rotating every other plate 180° in its own plane.

The symmetrical corrugations of the plates of these known heat exchangers provide for equal thermal properties of all the heat exchanging passages. This is the case even when two different kinds of plates are used alternatively, i.e., plates having differing angles of corrugation. What has been said above applies even for diagonal flow, which means that each of the heat exchanging media flows between openings provided at diagonally opposite corners of the plates.

It is often desirable to provide heat exchanging passages having different thermal properties for the two heat exchanging media in order to fulfill different objectives of heat exchange in the most efficient manner. A proposed solution for attaining this purpose is to provide alternate plates in the heat exchanger with a corrugation that is asymmetrical with respect to the central plane of the plate, so that the grooves have a larger volume on one side of the plate than on the other. In this way, it is possible to provide a heat exchanger in which the passages for the two media have different volumes and consequently differing thermal properties. However, this known solution is disadvantageous in that the corrugation cannot be effectively designed with regard to turbulence generation as well as pressure resistance.

The present invention has for its principal object to provide different thermal properties of the passages for the two heat exchanging media without any reduction of the turbulence-generating capacity or mechanical strength of the corrugations. In other words, the above-mentioned asymmetrical corrugations on alternate plates, which result in said reduction, are avoided so that all the plates of the present invention have corrugations which are symmetrical relative to the central planes of the respective plates. This has been obtained by a heat exchanger of the first-mentioned kind which is generally characterized in that the corrugations extend in such directions that they form on an average a wider angle with the flow direction of one of the media than with that of the other, whereby the passages for the two media provide mutually differing flow resistances.

Figure 2:
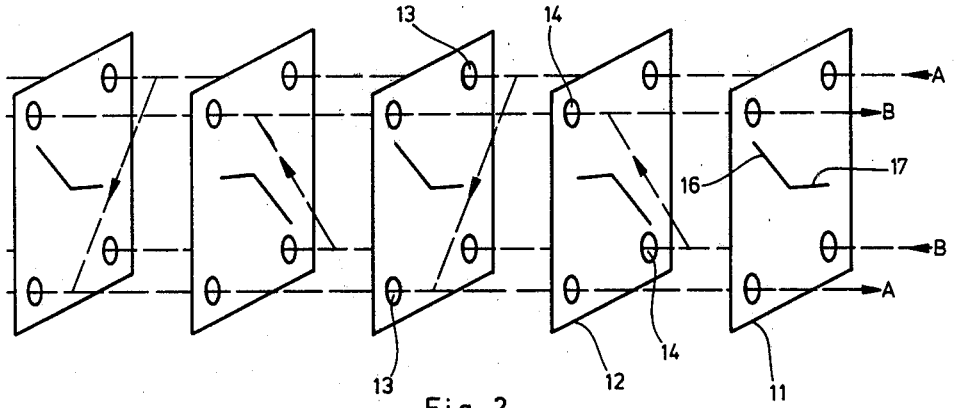

The invention will be described in more detail below with reference to the accompanying drawings, in which FIG. 1 is an exploded, diagrammatical perspective view of a conventional plate heat exchanger, FIG. 2 is a corresponding view of an embodiment of the heat exchanger according to the invention, and FIGS. 3–6 are diagrammatical plan views of preferred embodiments of heat exchanging plates to be used in the heat exchanger according to the invention.

The heat exchanger shown in FIG. 1 comprises a series of plates 1 and 2 arranged alternately and which are to be clamped together in a conventional manner in a frame-work which, for the sake of simplicity, has been omitted in the drawing. Two heat exchanging media A and B are conveyed via openings 3 and 4, respectively, to and from the heat exchanging passages formed between the plates, as is indicated by dashed lines. As can be seen, the inlet and outlet openings for each medium are disposed at diagonally opposite corners of the plates, whereby the flow directions of the media A and B are mutually inclined.

The plates 1 and 2 in FIG. 1 are provided with corrugations in a so-called herringbone pattern, as indicated at 6. The corrugation creases extend at the same angle a relative to the longitudinal axis 5 of the plates on both sides of said axis. To provide a mutual angle between the corrugations of adjacent plates, alternate plates are rotated 180° in their own planes.

It is obvious that in a heat exchanger assembled from plates 1 and 2 as defined above, which are completely symmetrical with regard to their longitudinal axis, all the heat exchanging passages will have identical thermal properties.

Figure 3:
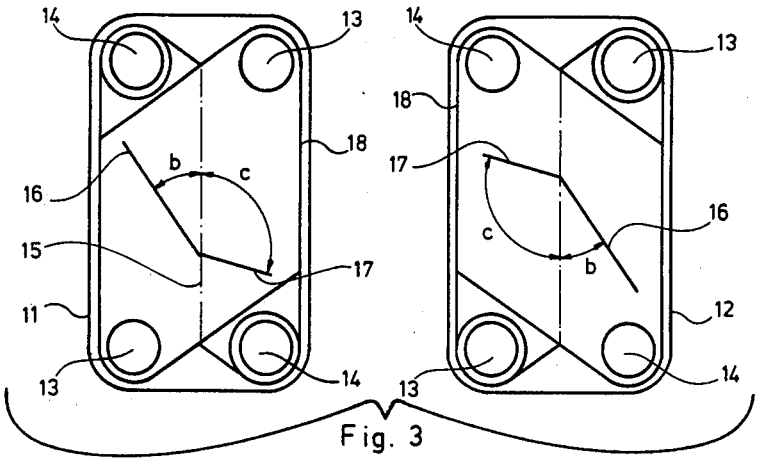

The heat exchanger according to the invention (FIG. 2) comprises a series of plates 11 and 12 shown on a larger scale in FIG. 3. The heat exchanging media A and B are conveyed to and from the heat exchanging passages via openings 13 and 14, respectively, situated at diagonally opposite corners of the plates. As in FIG. 1, the heat exchange thus takes place in cross-flow. The plates are provided with gaskets 18 as usual. The plates are further provided with corrugations in a herringbone pattern, the breaking line of which coincides with the longitudinal axis 15 of the plates. This "breaking line" is an imaginary line extending through the apices of the herringbones, where their two legs are joined. The diagrammatically indicated corrugation creases 16 and 17 are inclined to the longitudinal axis 15 at angles b and c, respectively, the angle c being considerably wider than the angle b. With the exception of the gasket arrangement 18, the plates 11 and 12 are identical, alternate plates being rotated 180° in their own planes.

By comparison of the angles of the corrugations with the flow directions of the media A and B through the heat exchanging passages, it is found that medium A meets the corrugations at a considerably wider angle than medium B. Medium A, which flows between openings 13, thus has a flow direction generally transverse to the corrugations, while the flow direction of medium B between openings 14 forms a relatively small angle with the corrugations. The flow resistance is therefore considerably higher for medium A than for medium B, and the thermal properties of the passages for the two media are therefore considerably different from each other. The difference of thermal properties is because the angles b and c are different.

Figure 4:
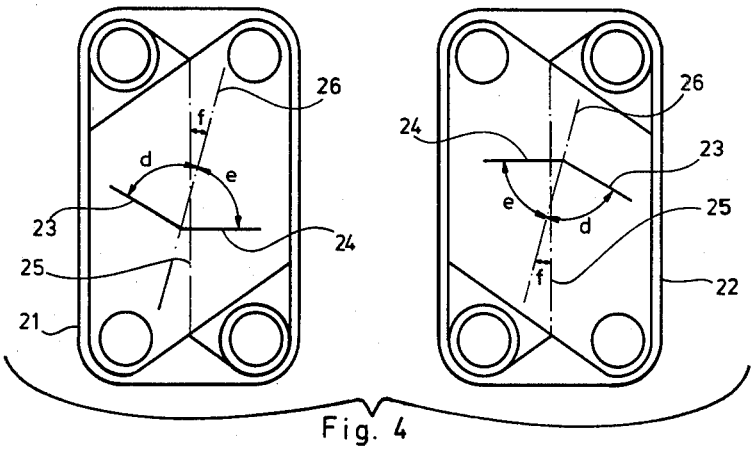
Figure 5:
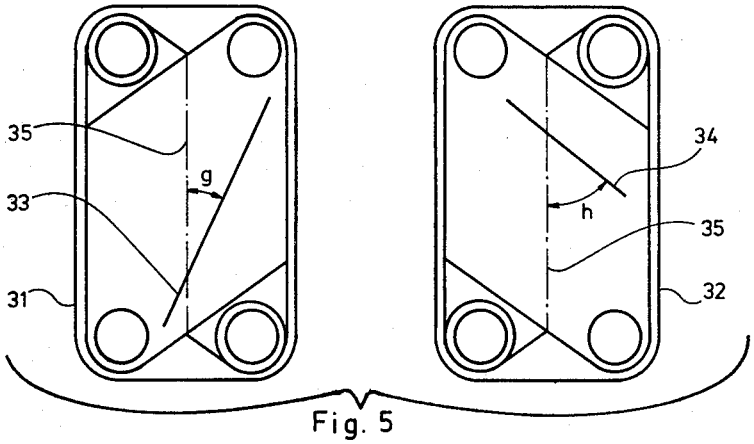
Figure 6:
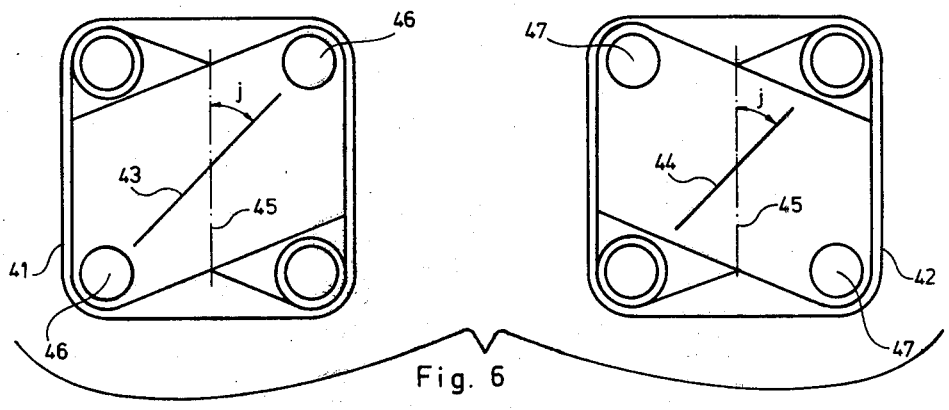

FIGS. 4–6 illustrate further embodiments of heat exchanging plates adapted to be arranged alternately in the same way as described above. The plates differ from those shown in FIG. 3 only with respect to the shape of the corrugation pattern, and therefore only this will be described.

The two plates 21 and 22 in FIG. 4 have identical corrugations, alternate plates being turned 180°. In this case the corrugation creases 23 and 24 are broken along a breaking line 26 and form angles d and e therewith, respectively. The breaking line 26 in turn forms an angle f with the longitudinal axis of the plate. The desired effect on the thermal properties of the passages according to the invention is obtained provided that the corrugation creases 23 and 24 extend at different angles relative to the longitudinal axis 25.

FIG. 5 illustrates two plates 31 and 32 provided with unbroken corrugations 33 and 34 forming angles g and H, respectively, with the longitudinal axis 35. Provided that these angles differ in width, the thermal properties of the heat exchanging passages will be different.

Even the plates 41 and 42 shown in FIG. 6 are provided with unbroken corrugations 43 and 44 which on both plates form an angle j with the longitudinal axis 45. Since the corrugations in this case are parallel and thus will not cross and abut each other, supporting points between the plates are instead provided in a known way by means of transverse ridges (not shown) between the corrugation creases. It is easily realized that a passage extending between openings 46 (i.e., generally parallel to the corrugations) offers a considerably less flow resistance than a passage extending generally transverse to the corrugations between openings 47.

The plates in FIG. 6 are shown square. This makes it possible to obtain the biggest possible difference of thermal properties of the passages for the two media. This is because the flow directions of the media in this case form the widest possible mutual angle (i.e., 90°). With a corrugation arranged as in FIG. 6, one of the media will flow generally parallel to the corrugation, which provides for the lowest possible flow resistance, while the other medium will flow generally transverse to the corrugation, which offers maximum flow resistance. By varying the angle j, it is possible to adapt the thermal properties of the passages mutually as required. The difference is biggest when j is 45°, as in FIG. 6, and is reduced towards zero when the angle approaches 0° or 90°.

The square format can of course be used with a different corrugation pattern than that shown in FIG. 6.

A person skilled in the art will easily realize that other corrugation patterns than those described above are possible within the scope of the invention.

I claim:

1. A plate heat exchanger comprising a plurality of generally rectangular plates arranged adjacent to each other and provided with turbulence-generating corrugations, said plates enclosing sealed heat exchanging passages for receiving two heat exchanging media flowing therethrough in mutually inclined main flow directions, the heat exchanger being characterized in that said corrugations extend in such directions that they form on an average a wider angle with the main flow direction of one of said media than with that of the other medium, whereby the passages for the two media provide different respective flow resistances.

2. The heat exchanger of claim 1, in which the plates are provided at their corner portions with inlet and outlet openings through which said media are conveyed to and from the heat exchanging passages, said inlet and outlet openings for each medium being provided at diametrically opposite corners of the plates.

3. The heat exchanger of claim 1, in which the plates are generally square.

4. The heat exchanger of claim 1, in which the corrugations of said plates are symmetrical relative to the central planes of the respective plates.

5. The heat exchanger of claim 1, in which said plates have respective longitudinal axes, said corrugations of each plate being arranged in a herringbone pattern and on each side of a breaking line extending through the apices of the herringbones, the corrugations on one side of said breaking line extending at a different angle relative to the plate's longitudinal axis than the corrugations on the other side of said breaking line.

6. The heat exchanger of claim 5, in which said breaking line of each plate coincides with the longitudinal axis of the plate.

7. The heat exchanger of claim 5, in which said breaking line of each plate is inclined to the longitudinal axis of the plate.

8. A plate heat exchanger comprising a plurality of generally rectangular elongated plates arranged adjacent to each other and provided with turbulence-generating corrugations, said plates enclosing sealed heat exchanging passages with crossing and abutting corrugations for receiving two heat exchanging media flowing therethrough in mutually inclined flow directions, said plates being provided at their corner portions with inlet and outlet openings through which said media are conveyed to and from the heat exchanging passages, said inlet and outlet openings for each medium being provided at diametrically opposite corners of the plates, the heat exchanger being characterized in that said corrugations of the plates extend in such directions that in passages for one of the heat exchanging media they form on an average an angle with the main flow direction of this medium which is wider than the corresponding angle in passages for the other medium, whereby the passages for the two media provide different respective flow resistances.

9. The heat exchanger of claim 8, in which the corrugations of each said plate are identical to the corrugations of the other plates.

10. The heat exchanger of claim 8, in which the corrugations of said plates are symmetrical relative to the central planes of the respective plates.

11. The heat exchanger of claim 8, in which said plates have respective longitudinal axes, said corrugations of each plate being arranged in a herringbone pattern and on each side of a breaking line extending through the apices of the herringbones, the corrugations on one side of said breaking line extending at a different angle relative to the plate's longitudinal axis than the corrugations on the other side of said breaking line.

12. The heat exchanger of claim 11, in which said breaking line of each plate coincides with the longitudinal axis of the plate.

13. The heat exchanger of claim 11, in which said breaking line of each plate is inclined to the longitudinal axis of the plate.

* * * * *